US011633047B2

(12) United States Patent
Rizzo

(10) Patent No.: US 11,633,047 B2
(45) Date of Patent: Apr. 25, 2023

(54) DECORATIVE LEG COVER FOR A BED FRAME

(71) Applicant: Sandra Rizzo, Kenosha, WI (US)

(72) Inventor: Sandra Rizzo, Kenosha, WI (US)

( * ) Notice: Subject to any disclaimer, the term of this patent is extended or adjusted under 35 U.S.C. 154(b) by 106 days.

(21) Appl. No.: 17/137,192

(22) Filed: Dec. 29, 2020

(65) Prior Publication Data

US 2021/0112990 A1 Apr. 22, 2021

Related U.S. Application Data

(63) Continuation-in-part of application No. 16/127,636, filed on Sep. 11, 2018, now abandoned.

(60) Provisional application No. 62/559,527, filed on Sep. 16, 2017.

(51) Int. Cl.

| | |
|---|---|
| ***A47C 21/00*** | (2006.01) |
| ***A47C 19/02*** | (2006.01) |
| ***A47C 19/22*** | (2006.01) |

(52) U.S. Cl.

CPC ..... *A47C 21/003* (2013.01); *A47C 19/024* (2013.01); *A47C 19/22* (2013.01)

(58) Field of Classification Search

CPC ..... A47C 21/003; A47C 19/024; A47C 19/22; A47C 21/00

See application file for complete search history.

(56) References Cited

U.S. PATENT DOCUMENTS

| | | | | |
|---|---|---|---|---|
| 4,323,610 | A | 4/1982 | Leverich | |
| 5,603,140 | A | 2/1997 | Pryce | |
| 6,012,185 | A | 1/2000 | Woods et al. | |
| 6,353,951 | B1 | 3/2002 | Gramling | |
| 6,647,589 | B1 | 11/2003 | Youngwith | |
| 10,030,855 | B1 | 7/2018 | Khubani | |
| 10,784,915 | B2 | 9/2020 | Montgomery | |
| 2005/0177949 | A1 | 8/2005 | Polevoy et al. | |
| 2010/0172143 | A1 | 7/2010 | Cunius | |
| 2012/0061545 | A1 | 3/2012 | Schneider | |
| 2012/0180216 | A1 | 7/2012 | Seehoff et al. | |
| 2017/0266522 | A1* | 9/2017 | Burgess | A63B 55/408 |
| 2018/0096634 | A1 | 4/2018 | Walker et al. | |

* cited by examiner

*Primary Examiner* — David R Hare
*Assistant Examiner* — Adam C Ortiz
(74) *Attorney, Agent, or Firm* — Amundsen Davis, LLC; Joseph S. Heino; Erin E. Kaprelian

(57) ABSTRACT

A decorative bed leg cover for a bed frame and at least one perpendicularly and downwardly-extending bed leg that is disposed in a substantially vertical position, the bed leg cover having a visually pleasing aesthetic appearance together with a substantially vertically-disposed aperture disposed within the bed leg cover body for receiving the bed leg within the bed leg cover body. The bed leg cover also includes a bed leg cover sidewall, a recess defined within the bed leg cover sidewall, and a light/sensor housing that is removably disposed within the recess of the bed leg cover sidewall, the light/sensor housing comprising circuitry between a proximity sensor and a light-emitting device.

10 Claims, 10 Drawing Sheets

DECORATIVE LEG COVER FOR A BED FRAME

This application is a continuation-in-part of U.S. patent application Ser. No. 16/127,636 filed Sep. 11, 2018 which claims priority to U.S. Provisional Patent Application No. 62/559,527 filed on Sep. 16, 2017.

FIELD OF THE INVENTION

The present disclosure relates to a decorative bed leg cover for a bed frame including a rectangular frame, with at least one perpendicularly extending leg, the leg connected to and extending from about a corner of the rectangular frame. More specifically, it relates to a bed leg cover that offers potential protection to a user by providing a proximity sensor and lighting element retained within the leg cover to temporarily illuminate the bed leg cover and the area around the bed leg cover. That is, the bed leg cover provides a means for avoiding inadvertent contact of the bed frame leg by the user when the user is in proximity to the bed frame leg as well as providing light to the floor area around the bed frame leg when there is not enough ambient light to see where the user is stepping about the bed or when the user needs to see under the bed, for example, for cleaning.

BACKGROUND OF THE INVENTION

Most beds have a mattress supported on a metal bed frame. The frame is a rectangular frame, with four perpendicularly extending bed frame legs also made of metal, each leg extending from about a corner of the rectangular frame. It is common to have a wheel attached to the bed frame leg for allowing the bed frame to be rolled around. While usually made of metal, it is to be understood that the bed legs can also be made of other materials, such as wood or plastic, and can be provided with or without wheels.

With such beds, the metal bed frame and its bed frame legs are often visible, and the frame legs are easily accessible from a side of the bed. As a result, it is not uncommon for a person to stub a toe against the bed frame leg or a wheel disposed at the bottom of the bed frame leg, if provided. Further, since most people often sleep in the dark, there is little if any light around a bed to aid a person in seeing where the bed frame legs are located.

What is needed is a way to cover the unsightly metal bed frame, the bed frame legs and the wheels disposed at the bottom of the legs, if provided, and to help prevent the user with light around the bed in the dark. Further, there is a need to provide a bed leg cover that is aesthetically-pleasing while providing the intended functionality of preventing toe stubbing that is not provided by the prior art. There is also a need to provide a bed leg cover that is made of a less rigid material to help prevent injury if a person accidentally kicks the bed leg, day or night.

SUMMARY OF THE INVENTION

Disclosed is a decorative bed leg cover having an outer shape or surface and a surrounding sidewall. The bed leg cover further comprises a substantially vertical top aperture for receiving a substantially vertical bed frame leg, with or without a wheel attached to the bed frame leg. The sidewall of the bed leg cover can be configured in a variety of shapes such as rectangular, tapered rectangular, square, tapered square, round, tapered round, etc. The bed leg cover can also be constructed as a unitary structure made of solid but deformable structural material that can accommodate the contour of the bed frame leg without changing the outer shape of the bed leg cover. This can be accomplished via an insert disposed within the bed leg cover or via the bed leg cover itself where the material used for the bed leg cover is the same deformable material throughout. In all constructions, however, the outer shape of the bed leg cover remains unchanged when the bed frame leg is received within the aperture of the bed leg cover. In other words, insertion of the bed frame leg into the bed leg cover does not change the outer aesthetic appearance of the bed leg cover.

The bed leg cover further comprises a light-emitting device defined within a housing and a light-emitting diode (or "LED") or other light-emitting device (collectively referred to herein as the "light-emitting device") that is disposed on or within a sidewall of the bed leg cover. The housing also comprises a proximity sensor on a visible side. By "visible", this is intended to be a side that allows the light-emitting device to project light from the bed leg cover and about the area of the bed leg cover in such a way that this surrounding area is preferably visible to a user. In the housing, the light-emitting device is accompanied by a leg cover proximity sensor. In the preferred embodiment, the housing is a square or rectangular shape, but is not so limited. An internal power source and internal circuitry of the housing enable the proximity sensor to electronically interact with the light-emitting device to turn the light-emitting device to a sustained light "on" condition when the user needs to keep the light of the bed leg cover "on" for an extended period of time, such as when cleaning under the bed. The device can also be set to a "sensor" position such that the proximity sensor is in a mode whereby it detects a moving object in its detectable sensing area by triggering the light-emitting device to a temporary light "on" condition. Once triggered, an internal timer allows the light-emitting device to move to the light "off" condition. This can be considered a "stand by" mode for the light-emitting device. The light-emitting device can also be set to an "off" position such that the triggering action is deactivated. The bed leg cover is preferably positioned such that the light, when in the "on" position, shines away from the bed leg cover and its surrounding area. However, the light may be directed under the bed to provide light for situations when light under the bed is required or desired. In short, the light-emitting device is enabled between a light "on" condition and a light "off" condition via either a switch "on" position, a switch "off" position and a switch "sensor" position.

As disclosed herein, the decorative bed leg cover is outfitted with the housing for the proximity sensor and the light-emitting device. One way to "mount" the housing is to provide a like-sized opening in a sidewall of the outer surface. The housing can then simply be placed within the opening via a friction fit. The opening can also be provided with corner retention members to hold the corner edges of the housing in place. The retention members may also be disposed elsewhere around and about the perimeter of the housing. Further, a scalloped shell shaped indent can be defined in the cover to aid in the removal of the housing such as when the preferred operation of the housing needs to be changed or its batteries need to be replaced.

The foregoing and other features of the decorative bed leg cover of the present invention will be apparent from the detailed description that follows.

DESCRIPTION OF THE EMBODIMENT

Figure 1:
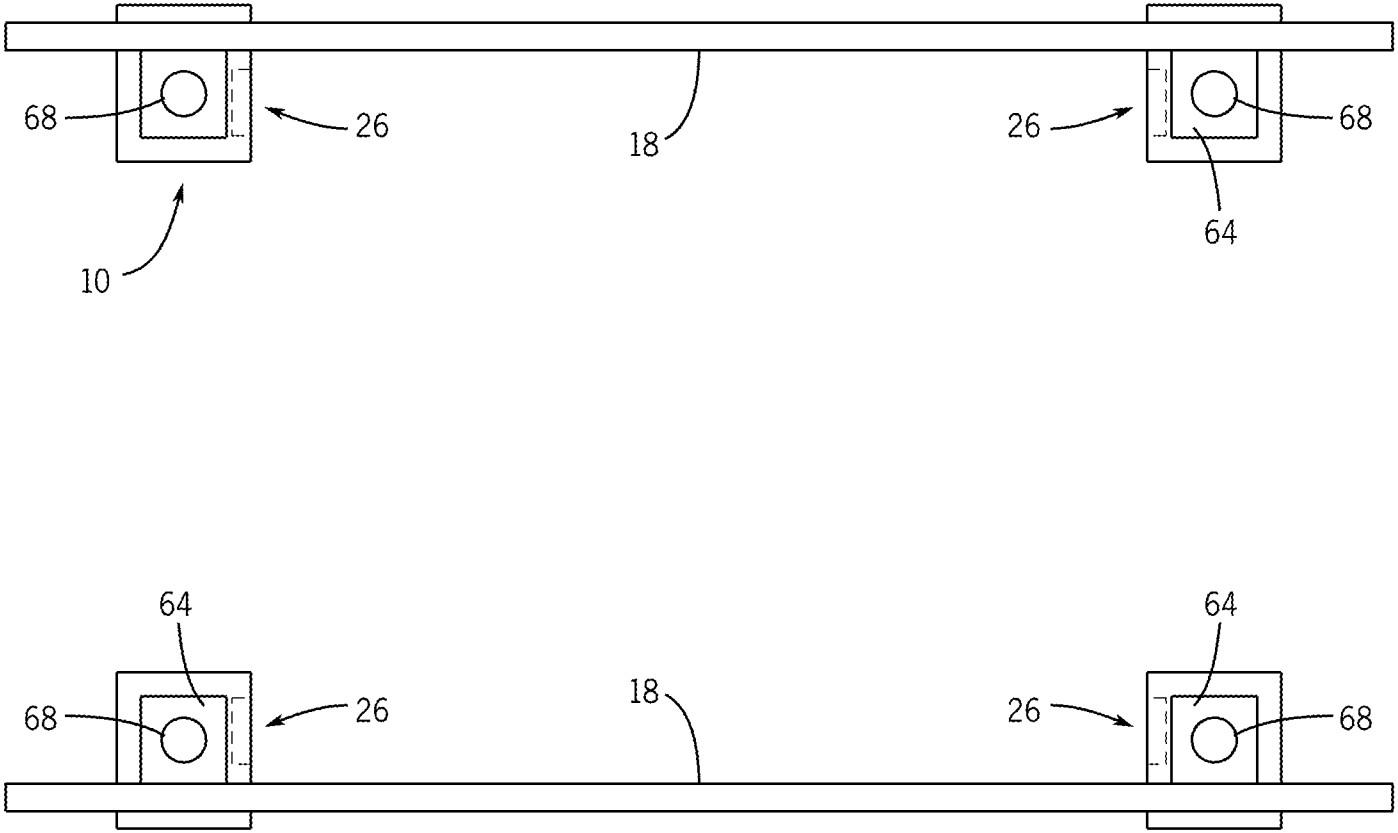
FIG. 1 is a top view of two pairs of bed leg covers, each pair having a side rail extending between the leg covers, the bed leg covers not being attached to one another.
Figure 2:
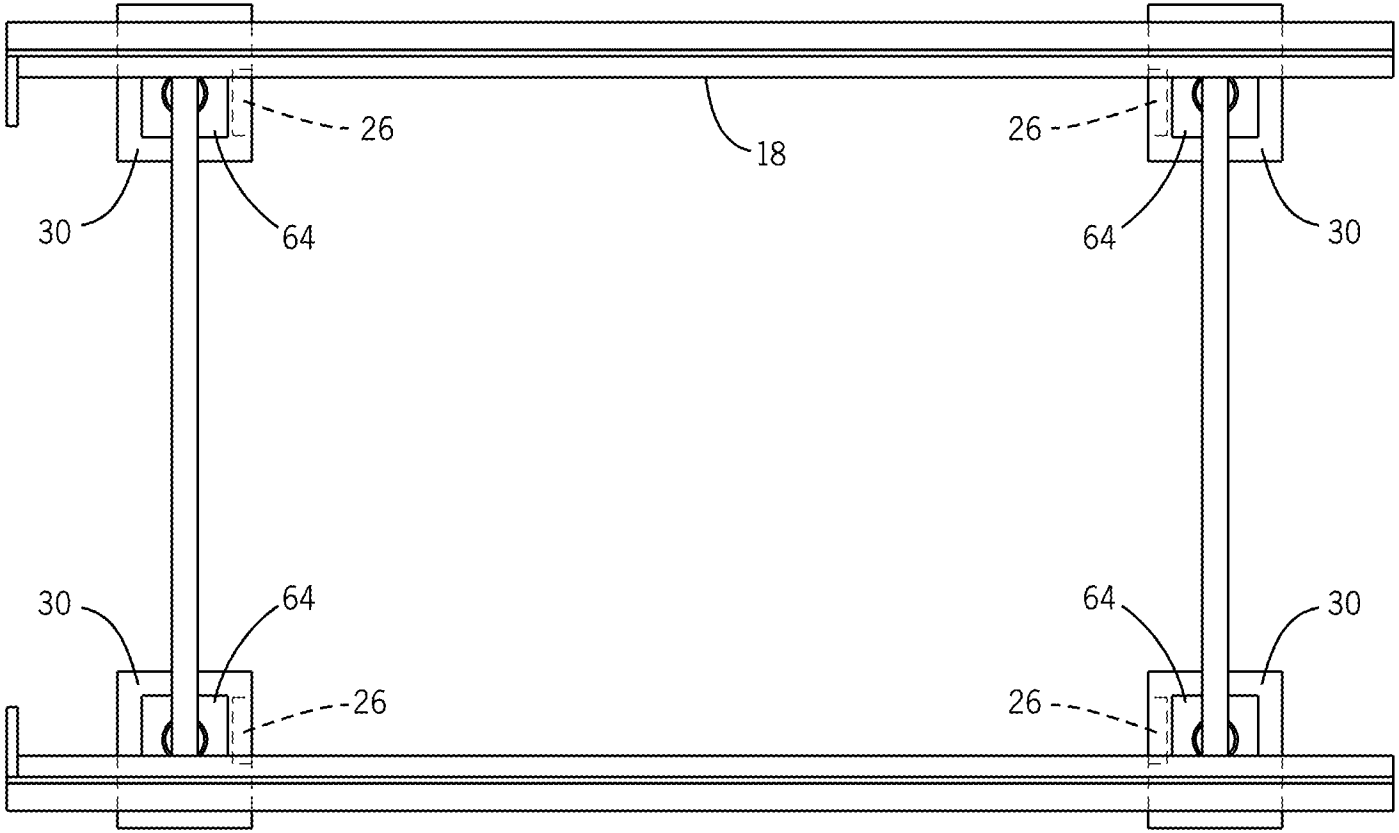
FIG. 2 is a top view of two pairs of leg covers in accordance with FIG. 1.
Figure 3:
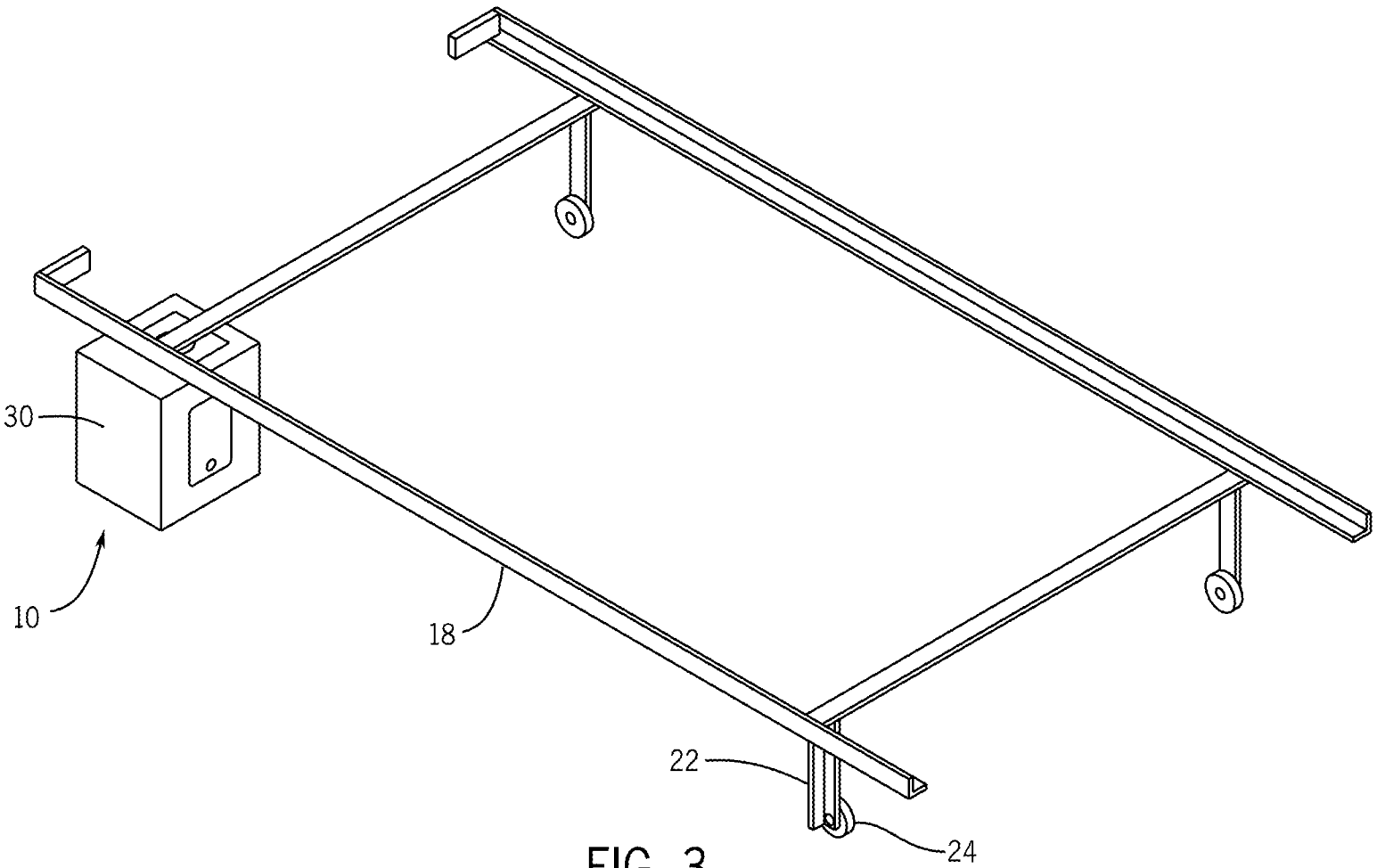
FIG. 3 is a side perspective view of a bed frame, with one bed leg received in a bed leg cover according to this disclosure.
Figure 4:
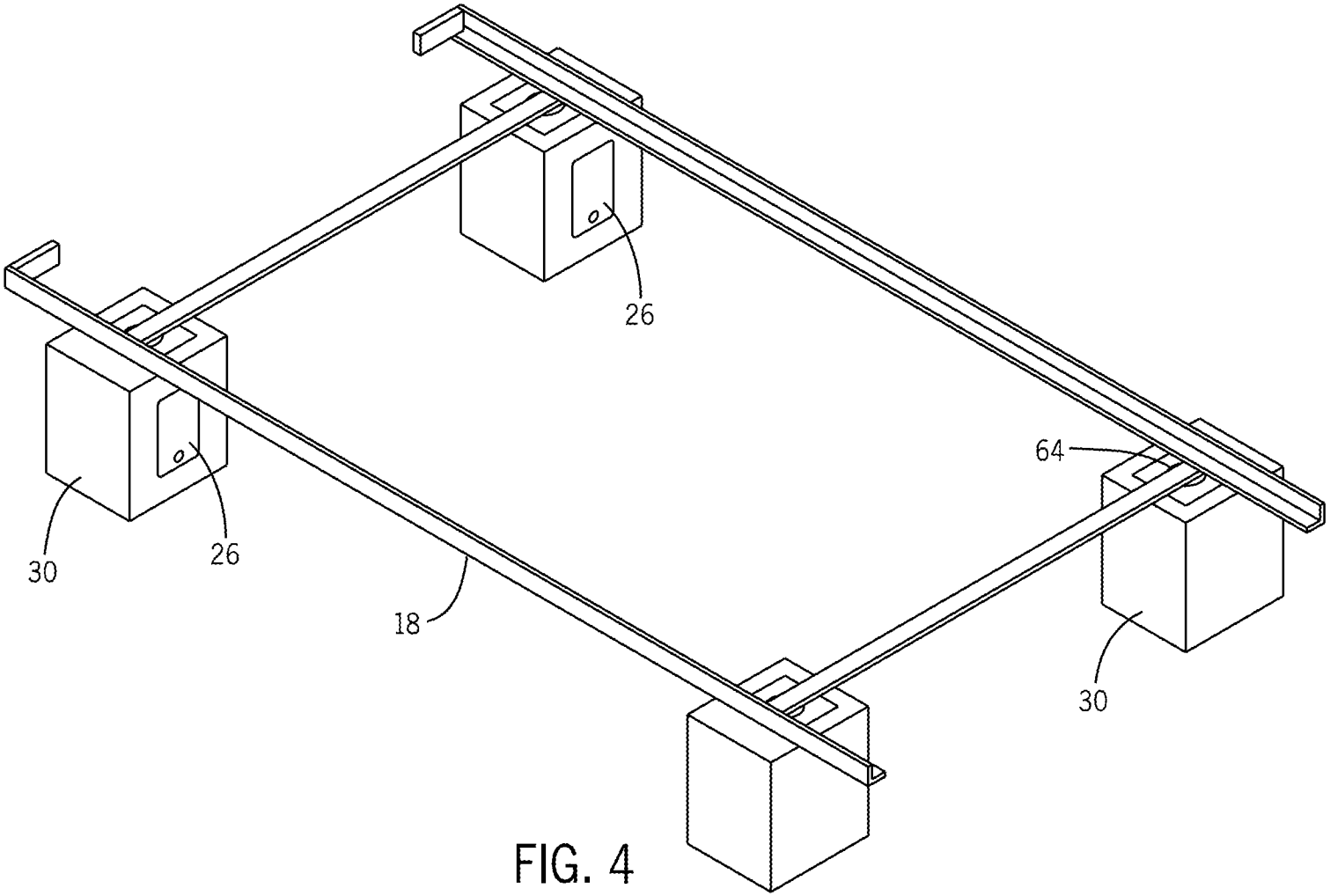
FIG. 4 is a side perspective view of a bed frame, with each of four bed legs received in a respective bed leg cover.
Figure 5:
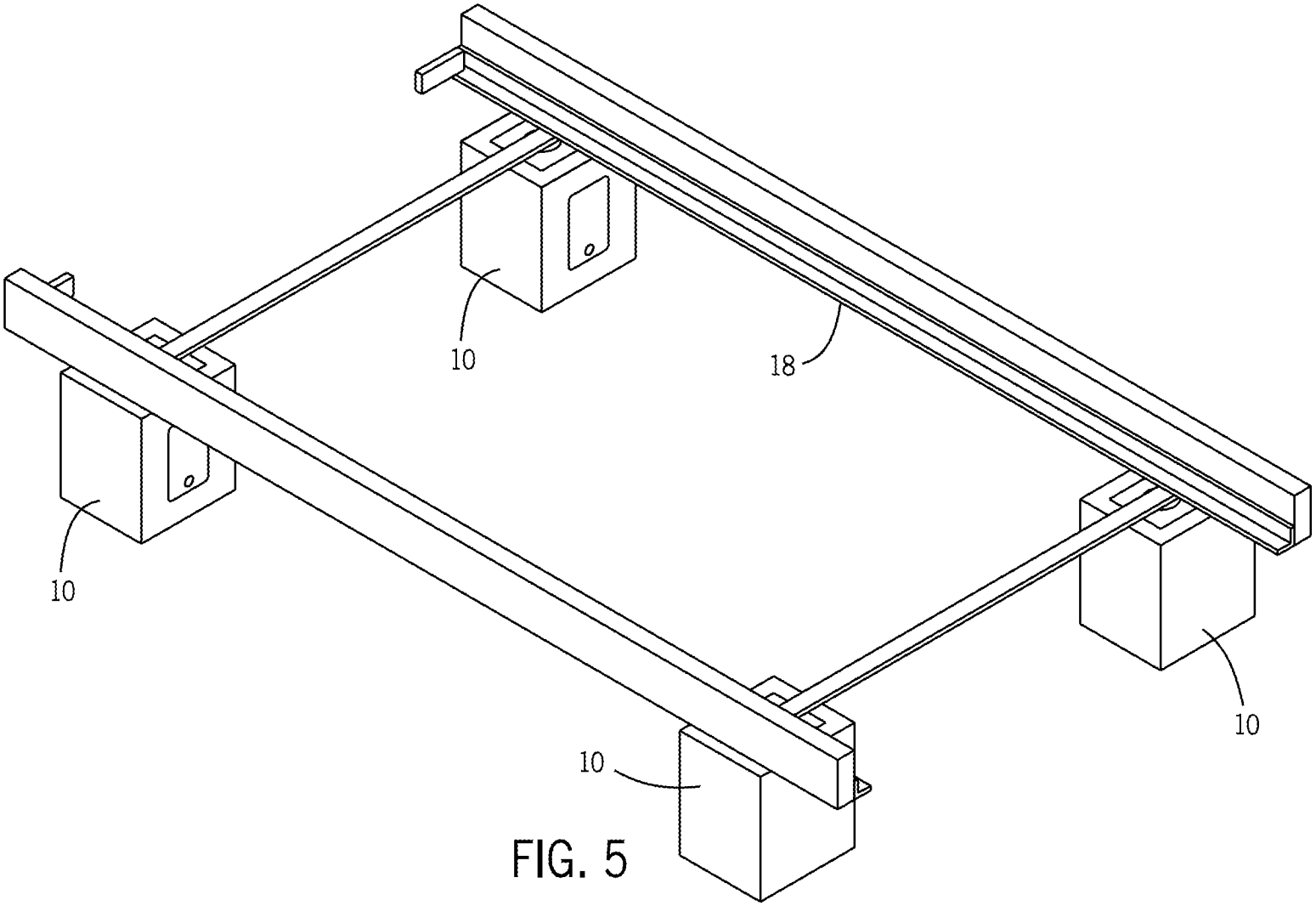
FIG. 5 is a side perspective view of a bed frame, with two pairs of bed leg covers, the leg covers not being attached to one another

Disclosed in FIGS. 1-8 is a decorative bed leg cover 10 for use with a bed frame 14, the frame 14 including a rectangular frame 18, with four perpendicularly and downwardly-extending bed legs 22, each leg 22 extending from about a corner of the rectangular frame 18, as shown in FIG. 3 in particular. The precise placement of the leg 22 relative to the frame 18 will vary between manufacturers and between different manufacturer configurations. The bed legs 22 may terminate in a wheel 24. See FIG. 8.

The bed leg cover 10 according to this disclosure significantly comprises several essential elements—a bed leg cover body 30, a substantially vertically-disposed receptacle or aperture 68 for receiving a bed leg 22 within the bed leg cover body 30, a bed leg cover sidewall 32, a receptacle or aperture for a light/sensor housing 26 defined within the bed leg cover sidewall 32, and a light/sensor housing 26 for removable placement into the sidewall receptacle or aperture. See, for example FIGS. 6, 7, 9 and 10.

More specifically, the bed leg cover body 30 comprises a top surface which has a bed leg-receiving aperture 68 for receiving a bed leg 22 therein. In the embodiments presented, the aperture 68 is surrounded by a shape forming material such that bed legs 22 of different types and configurations can be equally received within the aperture 68. In other words, the leg-receiving aperture 68 is uniformly conformable to the shape and contour of virtually any bed leg 22 of current design. In one illustrated embodiment, the aperture 68 is defined within the bed leg cover body 30. In another illustrated embodiment, the aperture 68 is defined within a secondary insert 64. This will be discussed in greater detail later in this detailed description.

Figure 7:
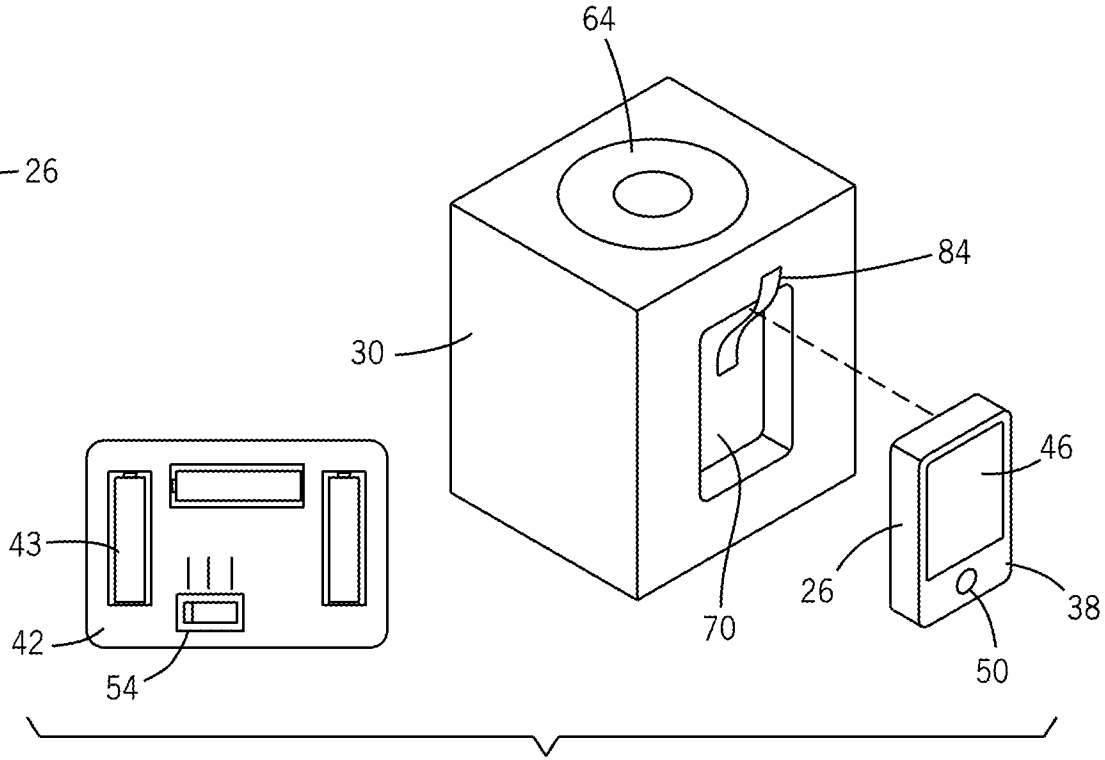
FIG. 7 is an exploded side perspective view of the bed leg cover of FIG. 6.
Figure 6:
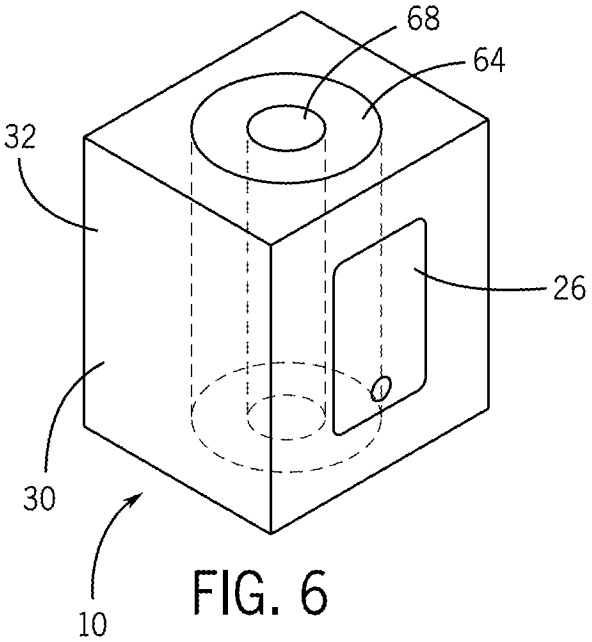
FIG. 6 is a side perspective view of a bed leg cover with a light/sensor housing mounted in an aperture such that light emitted from the light/sensor housing shines away from the aperture.
Figure 8:
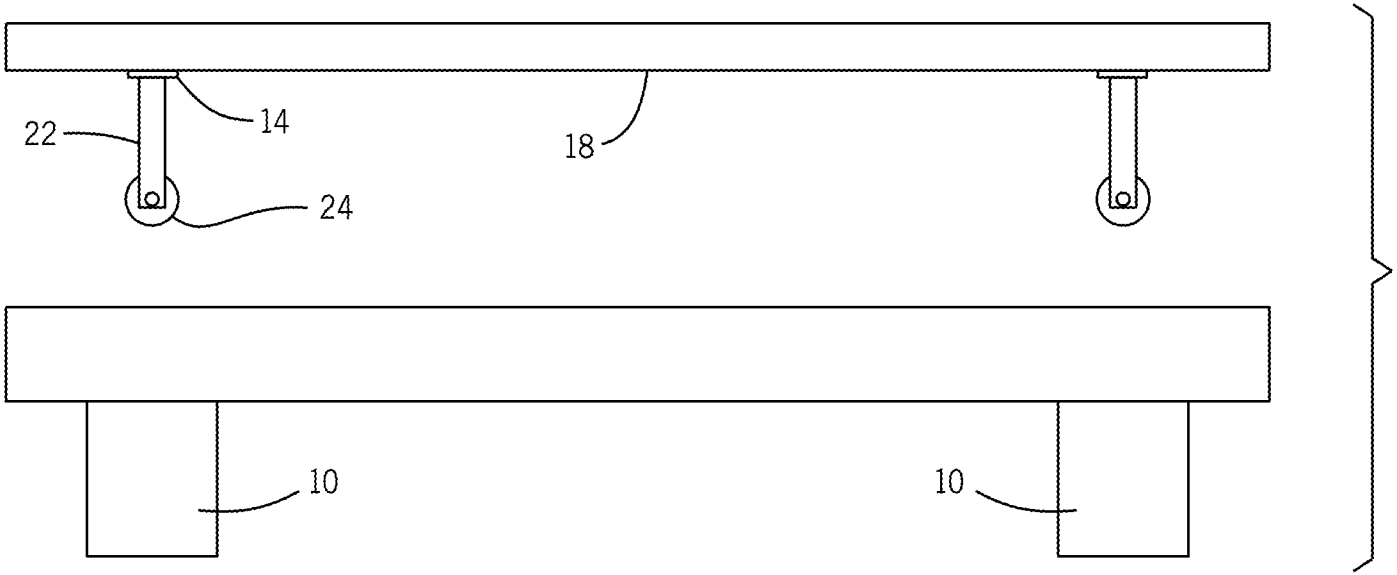
FIG. 8 is another side view of a pair of bed leg covers and wheeled legs.
Figure 9:
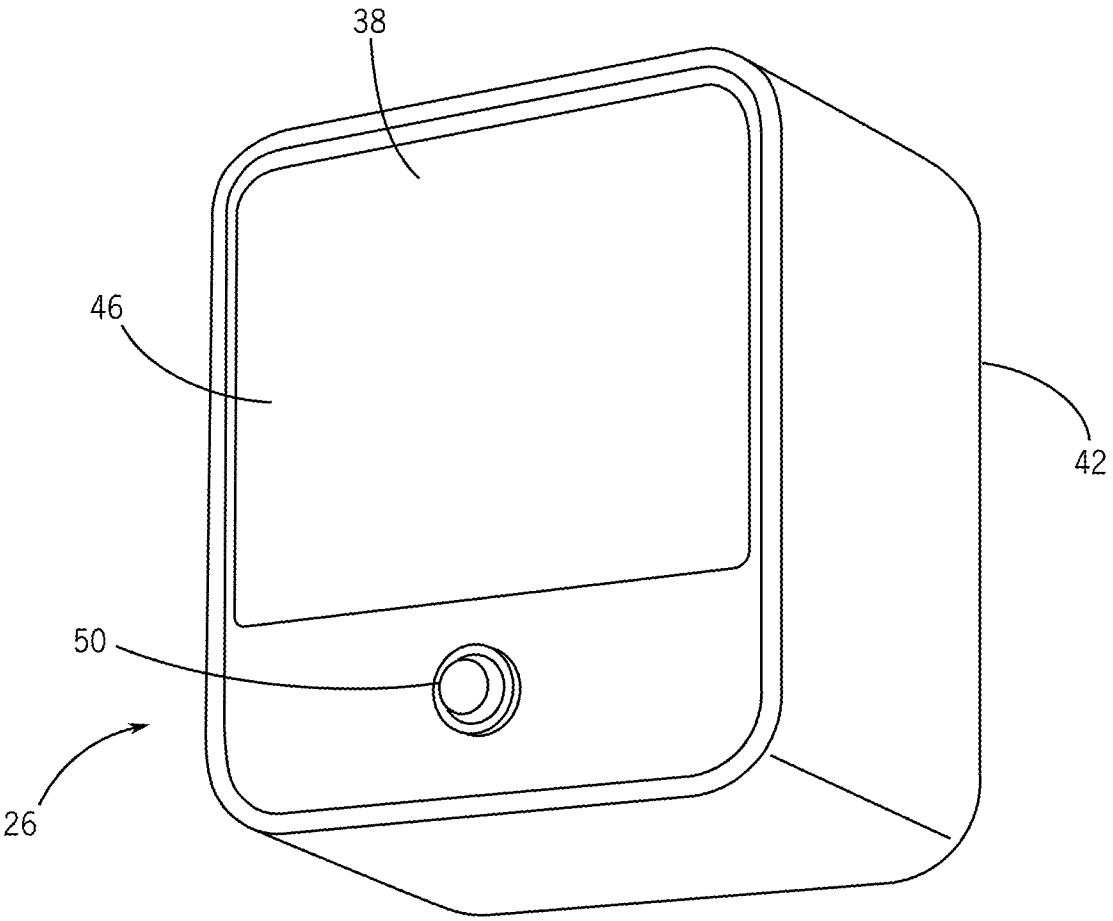
FIG. 9 is a front perspective view of a light/sensor housing according to this disclosure.

As shown in FIG. 7, the light/sensor housing 26 includes a front face 38 and a back side 42. A light-emitting diode (LED) or other low voltage light-emitting device 46 is disposed on the front face 38 of the light/sensor housing 26. The light/sensor housing 26 further includes a proximity sensor 50 of the type that is triggered by motion and is also disposed on the front face 38 of the housing 26. The light/sensor housing 26 also includes a switch 54 on the back side 42 thereof and provides for an "on" position, an "off" position and a "sensor" position. The light/sensor housing 26 is operable to be set in the "on" position via the switch 54 such as when sustained light is to be provided for an undetermined amount of time around and under the bed when desired or required. One such reason for this setting would be for cleaning, for example. When the light/sensor housing 26 is set to the "sensor" position, the proximity sensor 50 will be enabled to sense movement near or about the area surrounding the light/sensor housing 26 and the light-emitting device 46 will be enabled to be in a light "on" condition when movement is detected by the sensor 50, and alternatively operable to turn the light-emitting device 46 of the light/sensor housing 26 "off" after a pre-programmed amount of time. This is effectively a "stand by" mode. The light/sensor housing 26 can also be placed in an "off" position so as to deactivate both the light-emitting device 46 and the proximity sensor 50 when such is desired or required. One such reason for providing for this setting would be to save on the life of the batteries 43 during an extended absence of the user. Batteries 43 for the light/sensor housing 26 can be accessed and replaced from the back side 42 of the light/sensor housing 26. Such a light/sensor housing 26 is commercially available, for example, as Mr. Beams (trademark) MB722 Battery Powered Motion Sensing LED Stick Anywhere Night Light, White. The light/sensor housing 26 is relatively thin in thickness between the front face and the back side 38, 42, respectively. It is to be understood that contained within the housing 26 is conventional circuitry well known in the art to accomplish the functionality of the light/sensor housing 26 as described above. In short, it is to be understood that the light-emitting device 46 is enabled between a light "on" condition and a light "off" condition via either a switch "on" position, a switch "off" position or a switch "sensor" position. The switch "on" position effects a light "on" condition. The switch "off" position effects a light "off" condition. And the switch "sensor" position effects both a light "on" and a light "off" condition, which is dependent on the proximity sensor 50 sensing motion or no motion, respectively.

Continuing, the bed leg cover 10 is formed in a top-to-bottom contour of a four sided rectangular block (excluding the top and bottom surfaces that are flat and substantially planar, each in a horizontal plane) made of at least a rigid or semi-rigid material, such as wood or rubber. However, the shape is not so limited as the bed leg cover 10 could be configured, in addition to a rectangular or tapered rectangular block, as a square block, a tapered square block, a round block, a tapered round block, or another visually pleasing aesthetic contour or appearance. In the illustrated embodiment of FIGS. 6 and 7, the bed leg cover body 30 comprises of an aperture opening therein which is adapted to receive a pliable insert and a respective bed leg 22. The pliable insert 64 is deep enough to snugly receive and hold most of the bed leg 22. In the illustrated embodiment, pliable insert is a foam or foam-like material 64 is received in the aperture 60, the foam-like material 64 having a leg opening 68 therein adapted to receive the bed leg 22. The foam-like material can flow and conform to a variety of leg width dimensions, which helps to position and hold the leg 22 in the aperture 68.

Figure 10:
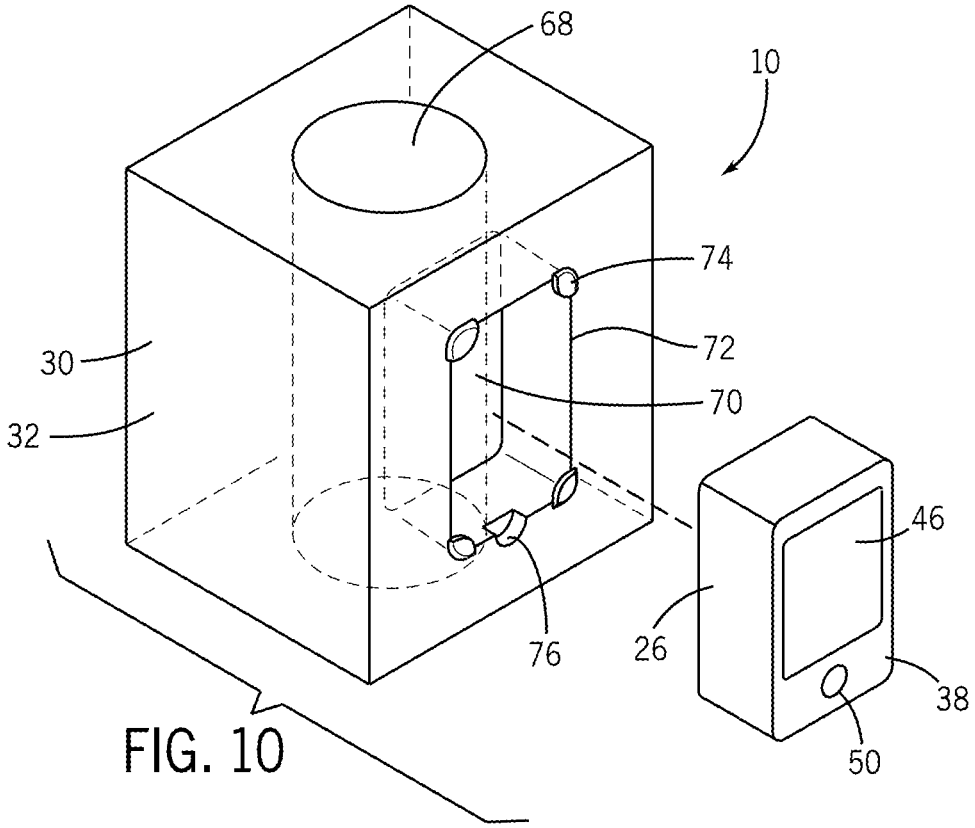
FIG. 10 is a view similar to FIG. 6 and showing the bed leg cover configured as a unitary structure and also showing the light/sensor housing prior to it being mounted in an aperture opening defined in the outer surface of the bed leg cover.
Figure 11:
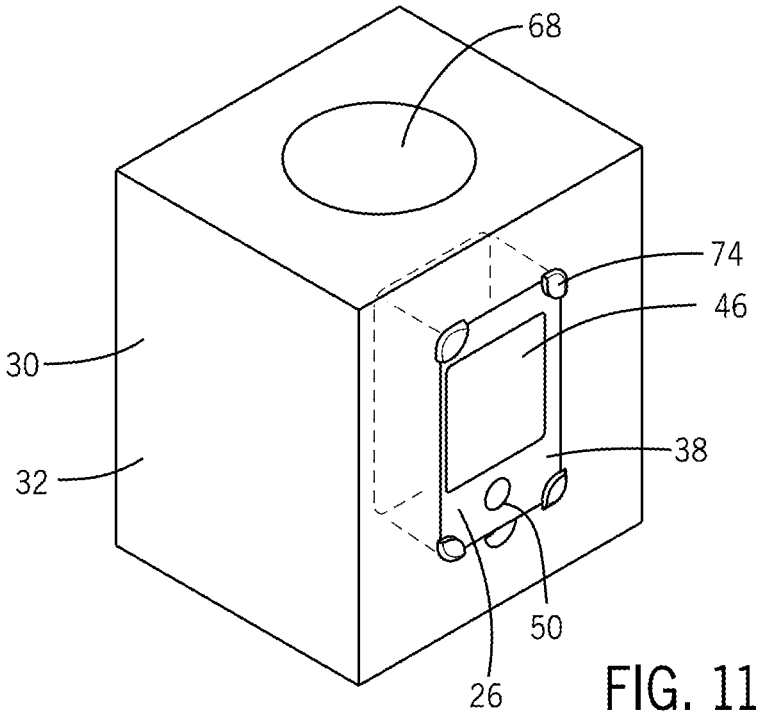
FIG. 11 is a view similar to that of FIG. 10 showing the light/sensor housing mounted in the aperture defined in the outer surface of the bed leg cover and showing the housing retained by retention members at the corners of the housing.
Figure 12:
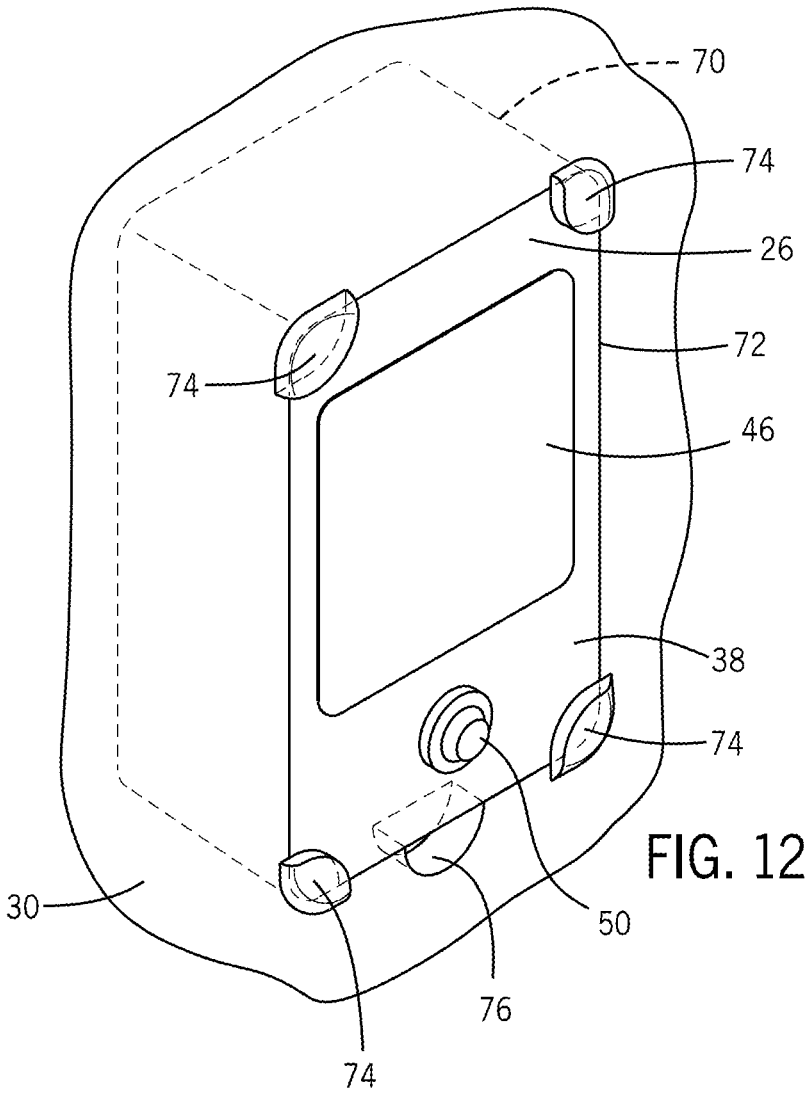
FIG. 12 is an enlarged view of the housing as illustrated in FIG. 11.

As shown in FIGS. 10-12, the bed leg cover body 30 is constructed of a solid square of foam or foam-like material having an outer sidewall 32, which sidewall 32 is configured to maintain its shape during use. That is, the leg opening 68 is also provided and is adapted to receive the bed leg 22 as described above. Whether the bed leg 22 is disposed within the bed leg cover body 30 or not, the exterior of the bed leg cover body 30 will maintain its shape. During use, the bed leg cover body 30, when made as a unitary structure, the bed leg cover body 30 must be durable enough to maintain its shape, but soft enough to allow the bed leg 22 to be inserted into the cover body 30 and then conform to the shape of that bed leg 22. The bed leg cover body 30 can be made of a closed cell foam and preferably, but not necessarily, a polyurethane foam construction which extends throughout the main body. That is, the bed leg cover body 30 is a unitary structure. Herein, the use of polyurethane foam will be deemed to encompass all suitable closed cell foams for the bed leg cover body 30. The material that is used is also preferably a low durometer elastomeric material on the Shore A hardness scale. That is, Shore hardness, using either the Shore A or Shore D scale, is the preferred method for determining the softness or pliability of rubbers/elastomers and is also commonly used for "softer" plastics such as polyolefins, fluoropolymers, and vinyls. The Shore A scale is used for "softer" rubbers while the Shore D scale is used for "harder" ones. The hardness value is determined by the penetration of a "durometer indenter foot" into a sample of the material. Ideally, the bed leg cover body 30 has a Shore A hardness ranging from one (1) to seventy (70), preferably about thirty-five (35). The softer Shore A hardness could include natural or synthetic polymers having elastic properties, e.g., rubber or other semi-rigid foam materials. It is also preferable that the bed leg cover body 30 is molded having a main body of a closed cell foam construction that extends throughout the main body. That is, the material of the bed leg cover body 30 is uniform throughout, including a closed cell foam material used throughout. In another embodiment, the material could be provided with a stiffer skin, outer layer, covering or coating thereon, this "skin" providing a more rigid outer layer for the bed leg cover body 30. The sidewall 32 is a stiffer plastic material. In short, the skin is the sidewall 32 of the bed leg cover body 30 results in the body 30 being flexible on the inside but tough on the outside—always maintaining its outer shape and overall aesthetics. In this way, the bed leg cover body 30 remains an aesthetically-pleasing structure irrespective of the shape of the bed leg 22 that is covered by the bed leg cover body 30. Lastly, a receptacle or aperture 70 is molded as part of the sidewall 32 as well.

In each illustrated embodiment herein, the light/sensor housing 26 is mounted within the sidewall 32 in an aperture or recess 70 that is defined within the exterior of the bed leg cover body 30. The recess 70 is configured to receive the light/sensor housing 26 therein so that the light-emitting device 46 shines away from the sidewall 32. When received in the recess 70, the front side 38 of the housing 26 is substantially flush with the sidewall 32. A ribbon 84 may be secured to one side of the recess 70, and another end free and extending across the recess 70 behind the light/sensor housing 26, with the free end outside the recess 70. The ribbon 84 aids in the removal of the light/sensor housing 26 from the recess 70 when needed to replace batteries, for example. See FIG. 7.

Alternatively, the outer periphery 72 of the recess 70 comprises a plurality of retention members 74 that extend inwardly of the recess 70 and extend only slightly outwardly of the sidewall 32. Such retention members 74 are shown in FIGS. 11-14. The retention members 74 serve to firmly hold the housing 26 within the recess 70 such that bed vibration or movement will not inadvertently dislodge the housing 26 from the leg cover 10. The low profile of the retention members 74 also prevents the retention members 74 from interfering with any light emanating from the light-emitting device 46 when the light-emitting device 46 has been triggered to be in the "on" condition by the proximity sensor 50. Although the illustrated embodiment shows four such retention members 74 for the square-shaped bed leg cover body 30 other numbers of retention members 74 could be used. For example, two opposing members 74 could be used—one to either side of the recess 70. By way of another example, the housing 26 could be circular in shape wherein only two opposing retention members would likewise be required. It is to be understood that a plurality of retention members 74 could be provided in any number and for any shape of housing 26 as desired or required. It is also to be understood that multiple housings 26 could be used within a single bed leg cover body 30.

Significantly, and as an alternative to using a pull ribbon of the type previously discussed, a finger insert divot 76 is formed in a portion of the outer periphery 72 of the recess 70 as a means for removing the housing 26 from the recess 70. As shown, the divot 76 is disposed below the housing 26 but need not be placed in that position. In this case, location of the divot 76 in a centered position and placed below the housing 26 results in good function and is aesthetically pleasing.

It is also significant that the retention members 74 are integrally formed as part of the bed leg cover body 30. That is, in the molding process, the retention members 74 are formed when the bed leg cover body 30 is molded.

In application, the bed leg covers 10 will be sold individually or in sets and not all of them will require lights. The user can specify which bed leg covers 10 will and will not have lights. The goal is to provide light, where desired, for walking about the bed in the dark or helping the user to see under the bed, for example, to clean. The bed leg covers 10 are made of a softer material to help prevent injury to the user's foot if it contacts the bed leg cover 10 as opposed to the bed leg 22 itself whether there is light available or not. The bed leg covers 10 also offer an aesthetic appeal.

Various other features of this disclosure are set forth in the following claims.

The invention claimed is:

1. A decorative bed leg cover for a bed frame and at least one perpendicularly and downwardly-extending bed leg that is disposed in a substantially vertical position, the bed leg cover comprising:

a bed leg cover body;

a substantially vertically-disposed aperture disposed within the bed leg cover body for receiving the bed leg within the bed leg cover body;

a bed leg cover sidewall;

a recess defined within the bed leg cover sidewall, wherein:

the recess includes an outer perimeter; and the outer perimeter of the sidewall recess includes at least one retention member for retaining a housing within the recess; and a light/sensor housing removably disposed within the within the recess of the bed leg cover sidewall, the light/sensor housing comprising circuitry between a proximity sensor of the type that is triggered by motion and a light-emitting device, the light-emitting device being enabled to be variably set to an "on" position, an "off" position, and a "sensor" position via a switch.

2. The decorative bed leg cover of claim 1 wherein the light/sensor housing further comprises an electric power supply provided for electric actuation of the proximity sensor and electric actuation of the light-emitting device.

3. The decorative bed leg cover of claim 2 wherein, when the switch is set in the "sensor" position, actuation of the proximity sensor results in light-emitting device actuation to a light "on" condition and the light-emitted device then being actuated to a light "off" condition in accordance with a preprogrammed scheme and after the passage of a predetermined period of time.

4. The decorative bed leg cover of claim 1 wherein the bed leg cover body is formed as a unitary structure.

5. The decorative bed leg cover of claim 4 wherein the bed leg cover body is a unitary structure that is molded of a deformable material.

6. The decorative bed leg cover of claim 5 wherein the bed leg cover encloses the deformable material to maintain the aesthetic appearance of the bed leg cover when the bed leg is received within the substantially vertically-disposed aperture.

7. The decorative bed leg cover of claim 1 wherein the bed leg cover has a top-to-bottom contour in the shape of one of the following:

a rectangle;
a tapered rectangle;
a square;
a tapered square;
round;
tapered round; or
another shape.

8. The decorative bed leg cover of claim 1, wherein the recess defined within the bed leg cover sidewall matches the shape of the housing.

9. The decorative bed leg cover of claim 1 wherein the outer perimeter of the sidewall recess further includes at least one finger-receiving divot for ease of removal of the housing from the bed leg cover.

10. The decorative bed leg cover of claim 5, wherein the sidewall is integrally formed with the molded body and is made of a material having a higher durometer of the molded body.

* * * * *